US009820914B2

(12) United States Patent
MacLeod et al.

(10) Patent No.: US 9,820,914 B2
(45) Date of Patent: Nov. 21, 2017

(54) INFANT FEEDING TEAT

(71) Applicant: APS INNOVATIONS PTY LTD, Carlton South, Victoria (AU)

(72) Inventors: Callum MacLeod, Carlton South (AU); Toby Hartley, Carlton South (AU); Mark Turner, Carlton South (AU); John Petschel, Carlton South (AU); Justin Armistead, Carlton South (AU); George Kotsiopoulos, Carlton South (AU); Diana Tomoiaga, Carlton South (AU)

(73) Assignee: Sepal IP Pty Ltd., Knoxfield, Victoria (AU)

( * ) Notice: Subject to any disclaimer, the term of this patent is extended or adjusted under 35 U.S.C. 154(b) by 0 days.

(21) Appl. No.: 14/891,556

(22) PCT Filed: May 16, 2014

(86) PCT No.: PCT/AU2014/000521
§ 371 (c)(1),
(2) Date: Nov. 16, 2015

(87) PCT Pub. No.: WO2014/183163
PCT Pub. Date: Nov. 20, 2014

(65) Prior Publication Data

US 2016/0120762 A1 May 5, 2016

(30) Foreign Application Priority Data

May 16, 2013 (AU) ..... 2013901742

(51) Int. Cl.
*A61J 11/02* (2006.01)
*A61J 11/04* (2006.01)
*A61J 9/04* (2006.01)

(52) U.S. Cl.
CPC ..... *A61J 11/02* (2013.01); *A61J 9/04* (2013.01); *A61J 11/04* (2013.01)

(58) Field of Classification Search
CPC ..... A61J 9/04; A61J 11/04; A61J 11/02
(Continued)

(56) References Cited

U.S. PATENT DOCUMENTS 1,118,134 A * 11/1914 Jones ..... A61J 9/04 215/11.5
1,672,734 A * 6/1928 Reilly ..... A61J 11/00 215/11.1

(Continued)

OTHER PUBLICATIONS

International Search Report for International Application No. PCT/AU2014/000521 mailed Jul. 14, 2014 (6 pages).

*Primary Examiner* — Sue A Weaver
(74) *Attorney, Agent, or Firm* — Merchant & Gould P.C.

(57) ABSTRACT

There is disclosed a drinking receptacle comprising: a container for containing a fluid for drinking; and an outlet member having an outlet through which the fluid is delivered under a pressure supplied by a user of the receptacle and a collar portion that attaches to an opening of the container such that an undersurface of the collar portion abuts with an upper surface of the opening of the container to form a substantially sealed engagement between the outlet member and the container; wherein either the undersurface of the collar portion or the upper surface of the opening of the container has at least one vent formed therein, the at least one vent being configured such that when said pressure is applied to the outlet member the at least one vent member permits the controlled ingress of air into the container to facilitate flow of fluid from the outlet, and when said pressure is removed the at least one vent member substantially prevents the ingress of air into the container to facilitate a controlled vacuum pressure within the container.

12 Claims, 13 Drawing Sheets

(58) Field of Classification Search
USPC ..... 215/11.5
See application file for complete search history.

(56) References Cited

U.S. PATENT DOCUMENTS

| | | | | | |
|---|---|---|---|---|---|
| 2,043,718 | A | * | 6/1936 | Tauf | A61J 9/04 215/11.5 |
| 3,190,288 | A | * | 6/1965 | Butler | A61J 11/02 215/11.5 |
| 3,193,125 | A | * | 7/1965 | Fischer | A61J 11/00 215/11.1 |
| 5,244,105 | A | * | 9/1993 | Serre | A61J 11/02 215/11.1 |
| 6,032,810 | A | * | 3/2000 | Meyers | A61J 11/02 215/11.1 |
| 2003/0034321 | A1 | | 2/2003 | Wu | |
| 2004/0256345 | A1 | | 12/2004 | Lundquist | |
| 2010/0170866 | A1 | | 7/2010 | Silver | |
| 2011/0155684 | A1 | | 6/2011 | Sirota | |

* cited by examiner

INFANT FEEDING TEAT

RELATED APPLICATION(S)

The present invention is a National Stage of PCT/AU2014/000521, mailed 16 May 2014, which claims benefit of Australian Provisional Patent Application No. 2013901742 filed 16 May 2013 and which applications are incorporated herein by reference. To the extent appropriate, a claim of priority is made to each of the above disclosed applications.

FIELD OF INVENTION

The present invention relates generally to the field of drinking receptacles, and in particular, to drinking receptacles for dispensing fluid for drinking purposes from an outlet by way of a sucking action applied to the outlet by a drinker. In a particular application, the present invention relates to an infant feeding bottle.

BACKGROUND OF THE INVENTION

Drinking receptacles come in a variety of different shapes and forms, depending upon the specific needs of the user. Generally, most drinking receptacles comprise a storage or bottle portion into which fluid is stored for drinking, and an outlet either attachable to the storage or bottle portion or formed in the storage or bottle portion, through which the fluid is able to flow to the user. The manner in which fluid flows from the storage or bottle portion through the outlet portion can also vary, with some outlet portions being configured to allow for liquid to freely flow therefrom, whilst others only permit fluid to flow from the outlet portion when a suction force is applied to the outlet portion.

A common type of receptacle that releases fluid upon the application of a suction force to an outlet is an infant feeding bottle. Infant feeding bottles generally comprise a cylindrical body portion for containing the fluid, such as expressed milk or infant formula, and a flexible teat portion attachable to an opening of the cylindrical body portion which is configured to be placed in the infant s mouth to release fluid to the infant as the infant applies suction to the teat portion. In this regard, most infant feeding bottles are based on the principal of replicating as close as possible a natural breast feeding situation, and as such, a variety of different shapes and styles of teats have been proposed in an attempt to more naturally replicate the process.

In most conventional infant feeding bottles, the teat portion is generally formed of two parts, a flexible teat and a collar. The flexible teat is typically made from an elastomeric material, such as silicone, TPF or similar material having an opening formed therein through which the fluid can flow and a flange formed around a perimeter of the material. In order to assemble the flexible teat to the cylindrical bottle, the flexible teat is typically placed over the opening to the cylindrical bottle such that the flange is positioned on the rim of the bottle and the collar portion is then placed over the flexible teat and screwed onto the cylindrical bottle such that the flange is captured between the collar and the rim of the bottle.

Such a conventional two-piece arrangement is able to be disassembled for cleaning and sterilisation purposes, which requires unnecessary handling of multiple parts by the user. Further, given the nature of the flexible, elastomeric material of the flange being sandwiched between two hard surfaces, namely the rim of the bottle and the collar portion, it is common that upon assembling the device for use, it is often overtightened in the process. This can have a significant negative effect on the flow of fluid from the teat, as the arrangement becomes air tight and air cannot enter the bottle to replace the fluid exiting the teat portion, significantly reducing the fluid flow.

Thus, there is a need to provide a receptacle having an outlet portion that facilitates improved flow of fluid therefrom. Also, when used as an infant feeding bottle, there is a need to provide a receptacle that is more naturally received within the infant's mouth and which provides for controlled delivery of fluid therefrom due to the natural sucking action applied by the infant.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

According to a first aspect, the present invention provides a drinking receptacle comprising: a container for containing a fluid for drinking; and an outlet member having an outlet through which the fluid is delivered to a drinker under pressure and a collar portion that attaches to an opening of the container such that an undersurface of the collar portion abuts with an upper surface of the opening of the container to form a substantially sealingly engagement between the outlet member and the container; wherein either the undersurface of the collar portion or the upper surface of the opening of the container has at least one vent formed therein, the at least one vent being configured such that when said pressure to the fluid to facilitate delivery of the fluid from the outlet, the at least one vent member permits the controlled ingress of air into the container to facilitate flow of fluid from the outlet and when the pressure is removed, the at least one vent member substantially prevents the ingress of air into the container to facilitate a controlled vacuum pressure within the container.

In one embodiment the pressure applied to facilitate delivery of fluid from the container via the outlet is a negative or vacuum pressure, which may be facilitated by a suction force applied to the outlet. In another embodiment, the pressure applied to facilitate delivery of fluid from the container via the outlet is a positive pressure, which may be facilitated by squeezing the container.

The at least one vent may be in the form of one or more channels formed in the undersurface of the collar portion or the upper surface of the opening of the container such that the channel extends across the abutting surfaces of the collar portion and the opening of the container. The abutting surfaces of the collar portion and the opening of the container may be made from a substantially rigid material having minimal flexibility so as to form a hard-to-hard surface engagement. In one embodiment, the substantially rigid material may be a hard plastic material, such as polypropylene.

According to a second aspect, the present invention provides a dispensing unit for an infant feeding bottle, comprising: a flexible teat portion configured to be at least partially received within the infants mouth; and a collar portion configured to be attachable to the infant feeding bottle; wherein both the flexible teat portion and the collar portion are integrally formed such that the internal surface of the unit is substantially continuous.

According to a third aspect, the present invention provides a teat portion for an infant feeding bottle, comprising: a body made from flexible material, the body having an upper surface configured to have a curvature that substantially conforms with the curvature of the infant's hard palate and a substantially flat bottom surface configured to receive the infant's tongue during feeding.

With regard to the third aspect of the invention, an orifice is located at a distal end of the body such that when the body is taken into the mouth of the infant, the orifice is positioned to deliver fluid at the hard/soft palate interface of the infant's mouth.

According to a fourth aspect, there is provided a teat portion for an infant feeding bottle comprising a body made from substantially flexible material, the body being configured to be received within the infant's mouth during use and comprising an upper concave surface and a lower concave surface and an outlet located at a distal end of the body for delivering fluid to the infant, wherein the point of inflection of the upper concave surface is offset closer to the outlet that the point of inflection of the lower concave surface.

BRIEF DESCRIPTION OF THE DRAWINGS

The invention may be better understood from the following non-limiting description of preferred embodiments, in which:

FIG. 14 shows a bottom perspective view of the outlet portion of FIG. 2 employing an alternative venting arrangement;

FIG. 15A shows a cross-sectional side view of the upper end of the bottle portion in accordance with an alternative embodiment of the present invention; and FIG. 15B shows vents formed in the upper surface of the opening of the bottle portion in accordance with the alternative embodiment of FIG. 15A.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to its application to an infant feeding bottle. However, it will be appreciated that the present invention could be equally applied to a variety of drinking receptacles that rely upon the application of a suction force to an outlet thereof to extract fluid.

Figure 1:
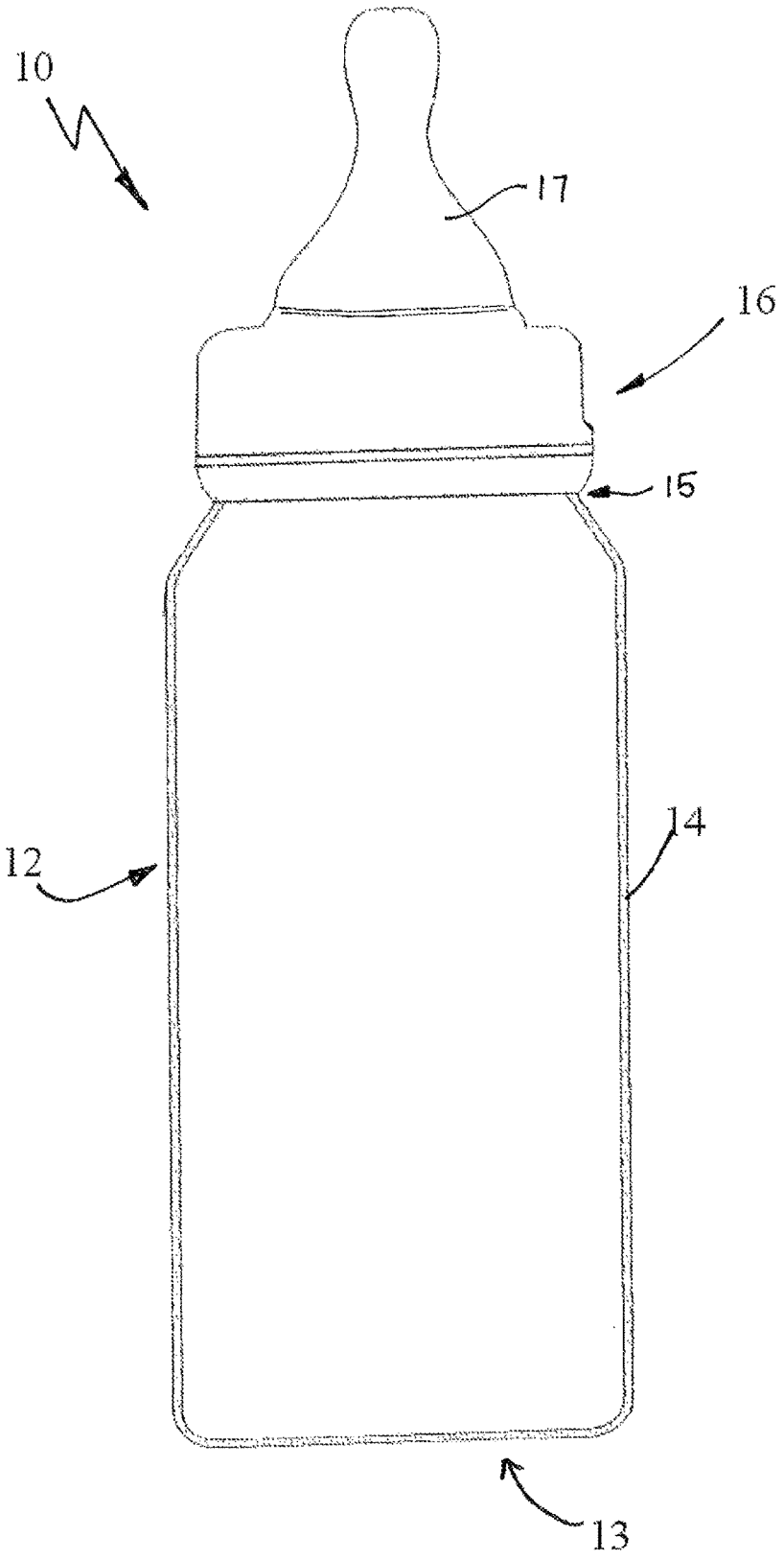
FIG. 1 is a side view of an infant feeding bottle in accordance with an embodiment of the present invention.

Referring to FIG. 1 a receptacle 10 is depicted in accordance with an embodiment of the present invention. The receptacle 10 is in the form of an infant feeding bottle comprising a cylindrical bottle portion 12 and an outlet portion 16. The cylindrical bottle portion 12 is circular in cross section and has a base 13, side walls 14 and an open upper portion 15, to which the outlet portion 16 is mounted. The bottle portion 12 is made from a hard plastic material which may be clear or coloured for aesthetic purposes. In the embodiment as shown, the upper portion 15 is narrower than the body of the bottle portion 12; however, it will be appreciated that other shapes and configurations of the bottle portion are also envisaged and fall within the spirit of the present invention.

Figure 2:
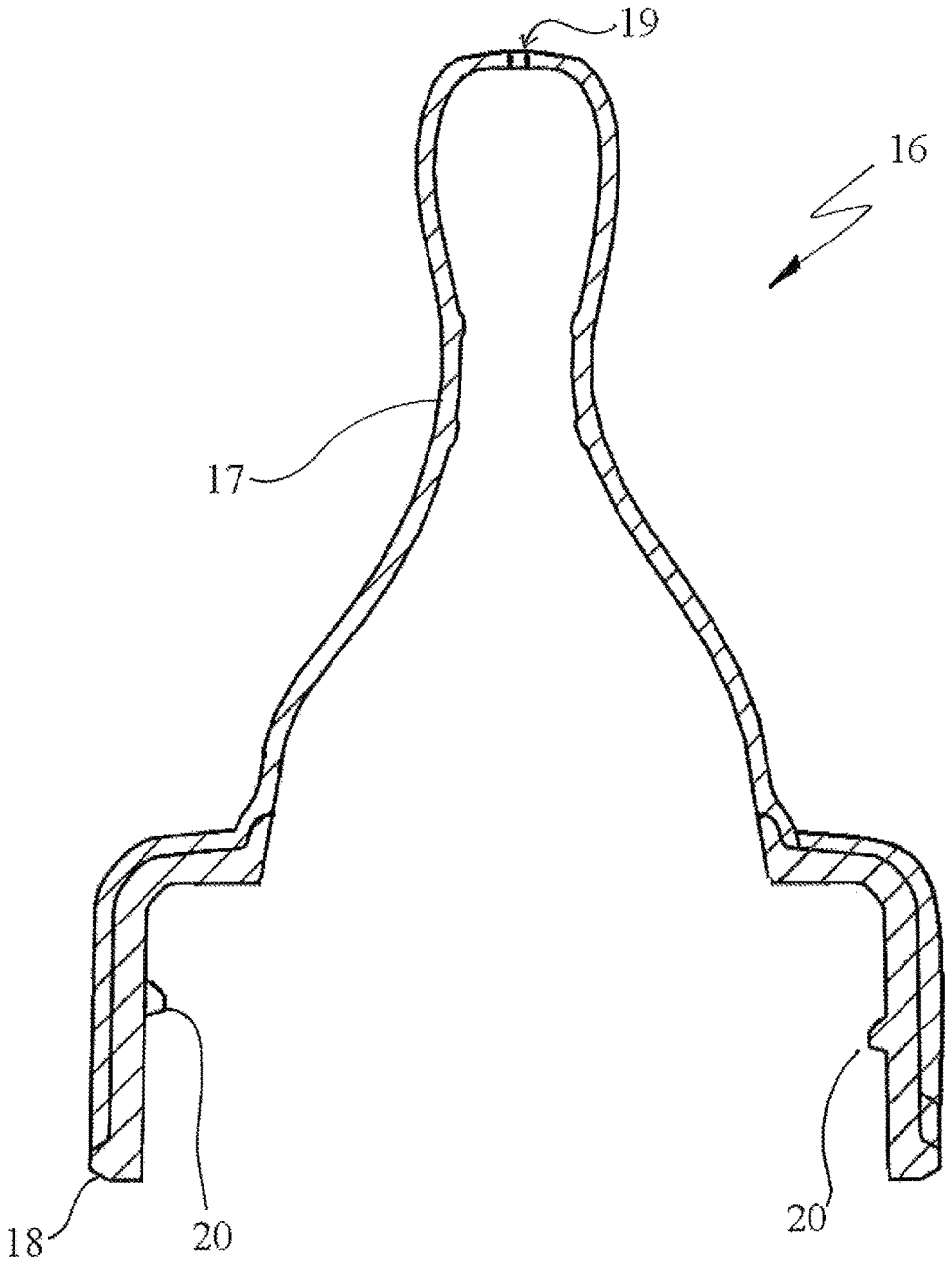
FIG. 2 is an enlarged view showing the outlet portion of the infant feeding bottle of FIG. 1.

An embodiment of the outlet portion 16 is shown in more detail in FIG. 2. The outlet portion 16 is formed as a single piece that comprises a teat member 17 made from a thermoplastic elastomer (TPE), such as styrene-ethylene-butylene-styrene (SEBS) or may be made from a flexible silicone rubber material. The outlet portion 16 also comprises a collar member 18 made from a hard plastic material, such as polypropylene. As is shown, the lower portion of the teat member 17 is formed over the outer surface of the collar member 18 such that the two members become an integral piece thereby having a substantially continuous inner surface. An outlet 19 is formed in the upper end of the teat portion 17, as shown, and functions in a manner as will be described in more detail below.

Figure 3:
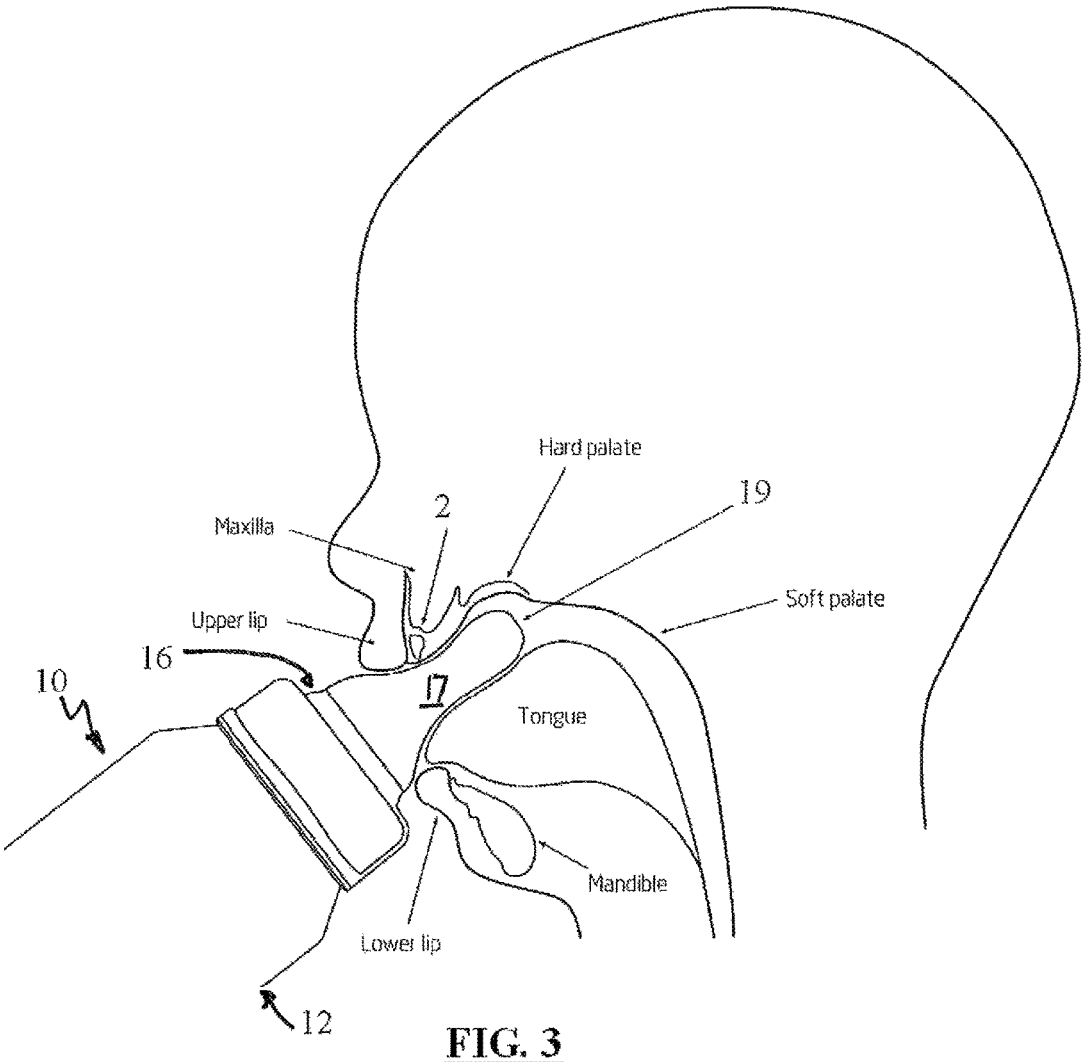
FIG. 3 depicts the infant feeding bottle of FIG. 1 in use.

The outlet portion 16 is fitted to the upper portion 15 of the bottle 12 by way of an internal thread 20 formed on the collar member 18. The internal thread 20 engages with an external thread formed on the upper portion of the bottle 12 to facilitate secure attachment of the outlet portion 16 to the bottle portion 12 of the receptacle 10, as is shown in FIG. 1. In this arrangement, as the upper portion 15 of the bottle 12 is open, fluid present in the bottle 12 is able to flow into the teat member 17 of the outlet portion 16 to substantially fill the internal space therein, so as to be delivered to the infant by way of the outlet 19, when a sucking motion is applied to the teat member 17 by the infant, as is shown in FIG. 3.

The teat member 17 is configured to assume a predetermined position within the infant's mouth when the infant initially receives the teat member 17. This position is similar to a position assumed by the breast and nipple during natural breast feeding. In this regard, the teat member 17 is self positioned within the infant's mouth into a desired position to provide a consistent and reproducible feeding experience each time the receptacle is used. FIG. 3 depicts the manner in which the receptacle 10 of the present invention is configured to facilitate flow of fluid from the bottle portion 12, through the outlet portion 16 and into the mouth of the infant. In this regard, upon the infant taking the teat member 17 into their mouth, the upper lip of the infant sits naturally against the corresponding region of the teat member as the upper lip flattens and pushes forward. This action results in the teat member 17 extending beyond the infant's alveolar ridge 2, towards the rear of the infant's hard palate, as shown. In this position, the infant is able to apply a suction force to the teat member 17 to draw fluid from the outlet 19. As part of this natural sucking action, the infant's bottom jaw typically lowers to enable the infant's tongue to extend forward and sit naturally against the underside of the teat member 17, as shown, thereby applying a seal at this region against the teat member 17. It will be appreciated that a natural sucking action requires a seal formed between the lips, tongue and inner cheek, when the jaw moves downwards. In a normal breast feeding situation, the breast and nipple are able to naturally conform to the infant's mouth, which is the naturally action that the present invention is seeking to replicate.

Figure 4B:
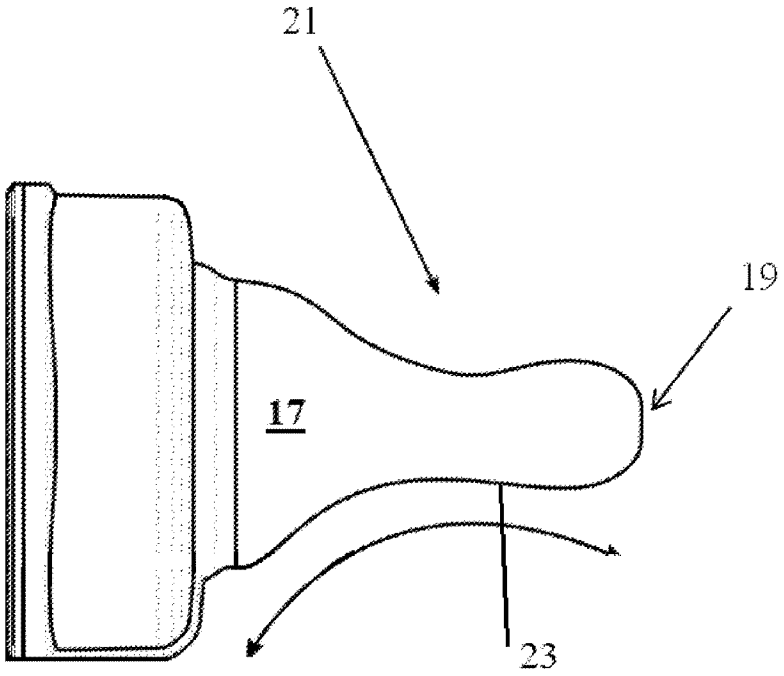
FIGS. 4A and 4B show side views of the outlet portion of the infant feeding bottle of FIG. 1.

During use, the teat member 17 undergoes relatively little deformation and maintains its general configuration. Thus, in order to take advantage of the natural feeding action of the infant, so as to self-position within the infant's mouth, the side profile of the teat member 17 of the present invention has been configured accordingly, as is shown in FIGS. 4A and 4B.

Figure 4A:
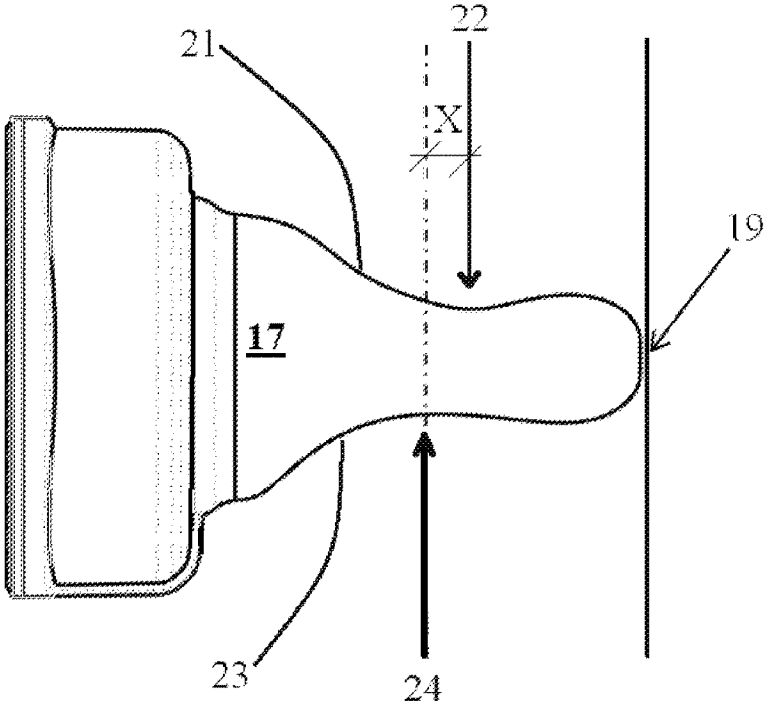

In FIG. 4A, the teat member 17 has a concave upper surface 21 and a concave lower surface 23. However, the point of inflection (POI) 22 of the concave upper surface 21 is offset a distance 'X' from the POI 24 of the concave lower surface 23. As is shown, the POI 22 of the concave upper surface 21 is disposed closer to the orifice 19 than the POI 24 of the concave lower surface 23. Such an arrangement enables the teat member 17 to be shaped such that when it is taken by the infant, the upper surface of the teat member 17 is able to clearly pass below the infant's alveolar ridge 2 such that the end region of the teat member is able to extend into the infant's mouth to rest against the infant's hard palate in a similar manner to natural breast feeding, as is shown in FIG. 3.

The flatter configuration of the concave lower surface 23, due in the main to the POI 24 being more distal the orifice 19 that the POI 22 of the concave upper surface 21, ensures that the infant's tongue is presented with a flatter surface against which they can readily place their tongue to form a seal against the concave lower surface 23 as is also shown in FIG. 3. This enables the infant to form a latching vacuum about the teat member 17 is a more natural manner.

As well as the side profile of the teat member 17 being configured to facilitate a more natural and readily repeatable position within the infant's mouth for feeding, the end profile of the teat member is also configured to provide an improved feeding experience for the infant. This is depicted in FIGS. 5A and 5B.

Figure 5A:
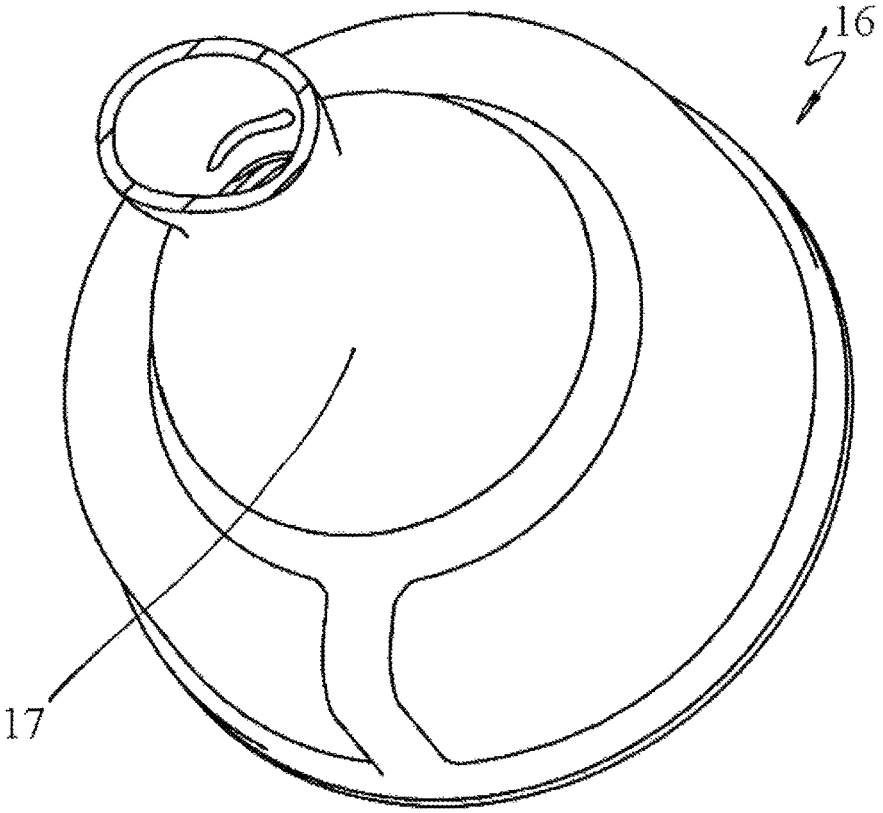
FIG. 5A shows a perspective top view of the outlet portion of FIG. 2.
Figure 5B:
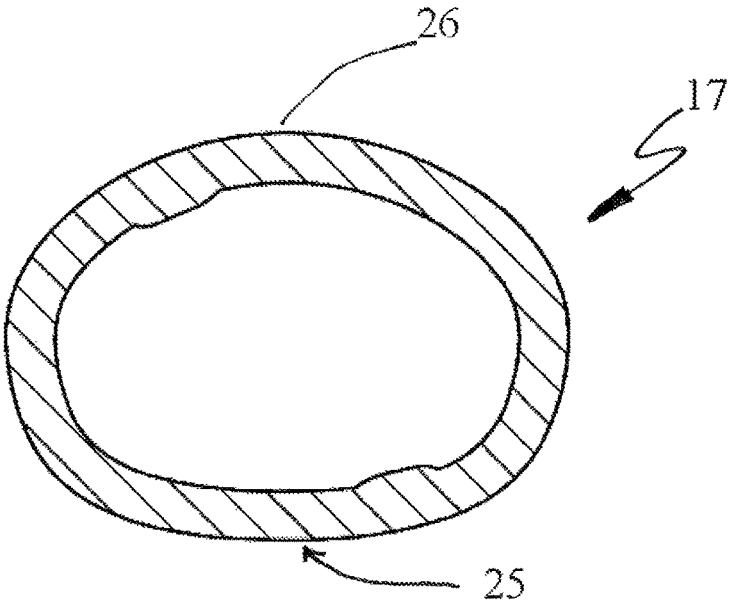
FIG. 5B is a cross-sectional end view of the teat portion of the outlet portion of the infant feeding bottle.
Figure 6:
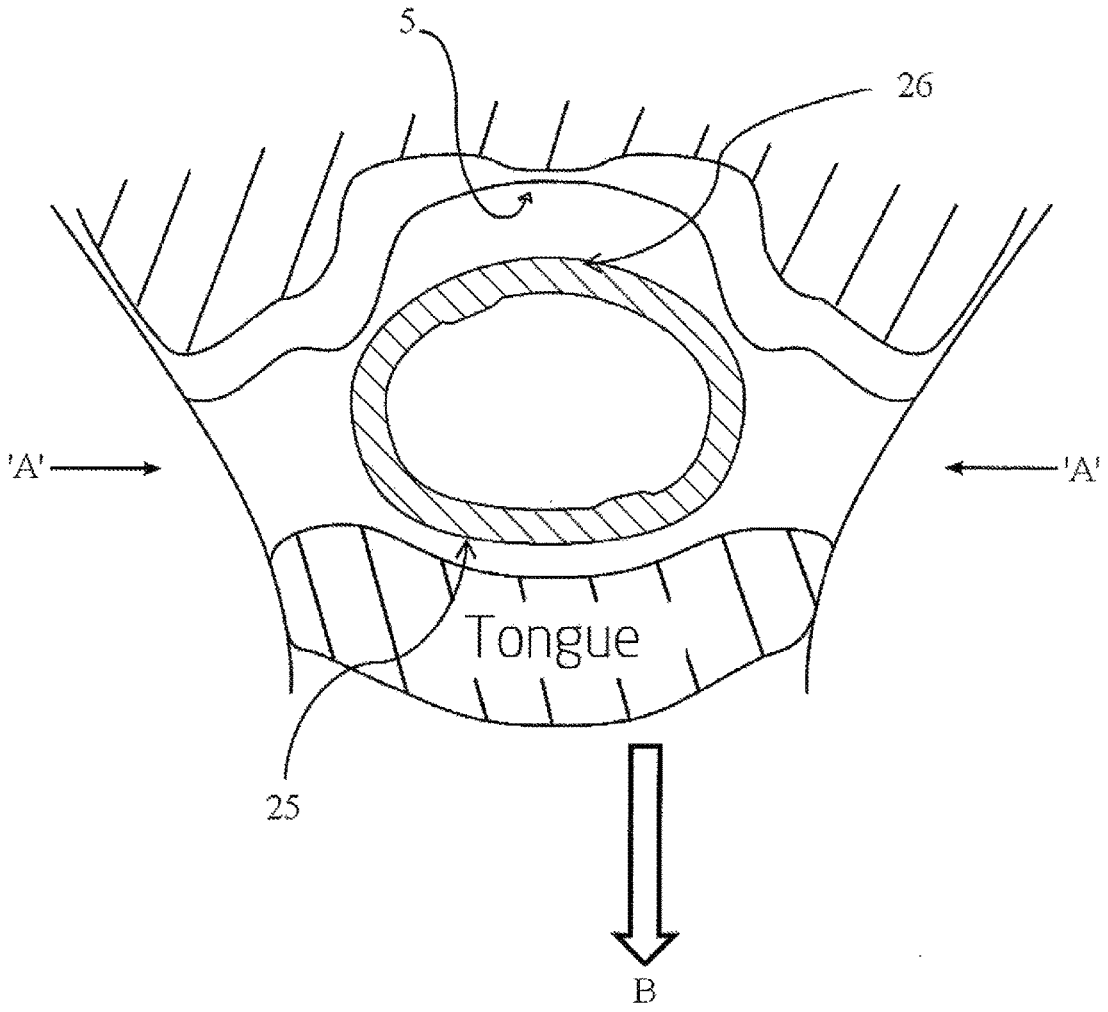
FIG. 6 shows a view of the teat portion of FIGS. 5 A and 5B in use.

In FIG. 5A, the outlet portion 16 is shown from a top perspective view with the end portion of the teat member 17 removed. The end portion of the teat member 17 is shown in cross sectional view in FIG. 5B. As can be readily appreciated, the under surface 25 of the teat member 17 is configured to be substantially flat in comparison with the upper surface 26, which has a substantially consistent curvature. The curvature of the upper surface 26 is configured to substantially match the curvature of the hard palate 5 of the infant, as is shown in FIG. 6. Similarly, the flatter configuration of the under surface 25 provides a surface against which the infant's tongue is able to rest against to enable the tongue to be flatter so as to more easily make contact with the infant's cheeks during the feeding session.

Referring to FIG. 6, the manner in which the end profile of the teat member 17 has been configured to improve the feeding action of the receptacle 10 can be seen. In this regard, during a sucking motion, the infant's cheeks are drawn in, in the direction of arrow 'A' such that they are able to contact each side of the infant's tongue to create a seal and vacuum about the teat member 17. At the same time, during the sucking stroke, the infant's jaw and tongue is able to move in a downward direction (arrow 'B'). By providing a flatter under surface 25, the teat member 17 does not prevent the infant's cheeks from contact with the tongue thereby ensuring that the seal and vacuum is maintained during the sucking motion to ensure that optimum fluid is delivered from the outlet 19 of the teat member 17, so as to replicate a more natural breast feeding action. As the upper surface 26 of the teat member 17 is configured to match the curvature of the infant's hard palate; the infant is able to sealingly engage with the teat member 17 in a desirable manner, and in a manner that is consistently reproducible each time the teat member is taken by the infant.

As well as providing a teat member 17 that functions to better replicate a natural breast feeding situation when the teat member is present in the infant's mouth, the present invention also provides a system that ensures improved fluid flow from the teat member.

As most drinking receptacles require a degree of sealing to avoid inadvertent fluid leakage from the receptacle, it is important that, when the receptacle is in use, there is sufficient venting of air into the receptacle to ensure that fluid is able to flow from the outlet of the receptacle.

For an infant feeding bottle, this is particularly the case as the infant typically supplies significant suction to the teat member during use to extract the fluid therefrom, and in order to replace the fluid taken, air must enter the bottle to accommodate the vacant space. Thus, in providing an infant feeding bottle, it is important that there is present a degree of vacuum within the bottle to enable the infant to apply a natural latching action during rest periods and/or suction force to the bottle to extract the fluid during feeding periods. This ensures that the feeding situation resembles as close as possible, a natural breast feeding situation.

As previously discussed a common problem with conventional infant feeding bottles that employ a teat member and separate collar is that, in the act of fastening the teat member to the bottle portion when assembling the components of the device, the arrangement is typically overtightened. Generally, where the teat member is employed with a removable collar, the collar and the upper rim of the bottle portion function to secure the flange portion of the flexible teat member therebetween, so as to facilitate secure engagement of the various components. As the bottle is often shaken after assembly to facilitate mixing of the milk product, there is a natural tendency to screw the collar more tightly than necessary to the bottle portion such that the soft and flexible flange member deforms between the two hard surfaces of the collar and the bottle, to form a substantially air-tight seal. This air-tight seal may be useful in preventing inadvertent leakage of fluid from the bottle, but it also prevents air from entering the bottle during feeding and thus prevents desired flow of fluid from the bottle to the infant.

The present invention addresses this problem by providing a one-part outlet portion 16 as discussed above in relation to FIG. 2. By providing the flexible teat member 17 such that it is moulded over the hard collar member 18 as shown, when the outlet portion 16 is attached to the upper rim 15 of the bottle portion 12, there is no soft, flexible material being sandwiched between the hard collar member 18 and the hard upper rim of the bottle portion 12. Rather, the collar member 18 and the bottle portion 12, which are both made from a hard plastic material, are able to be tightly screwed together without fear of the seal between the two components becoming airtight and preventing the receptacle from being able to vent during use.

Figure 7:
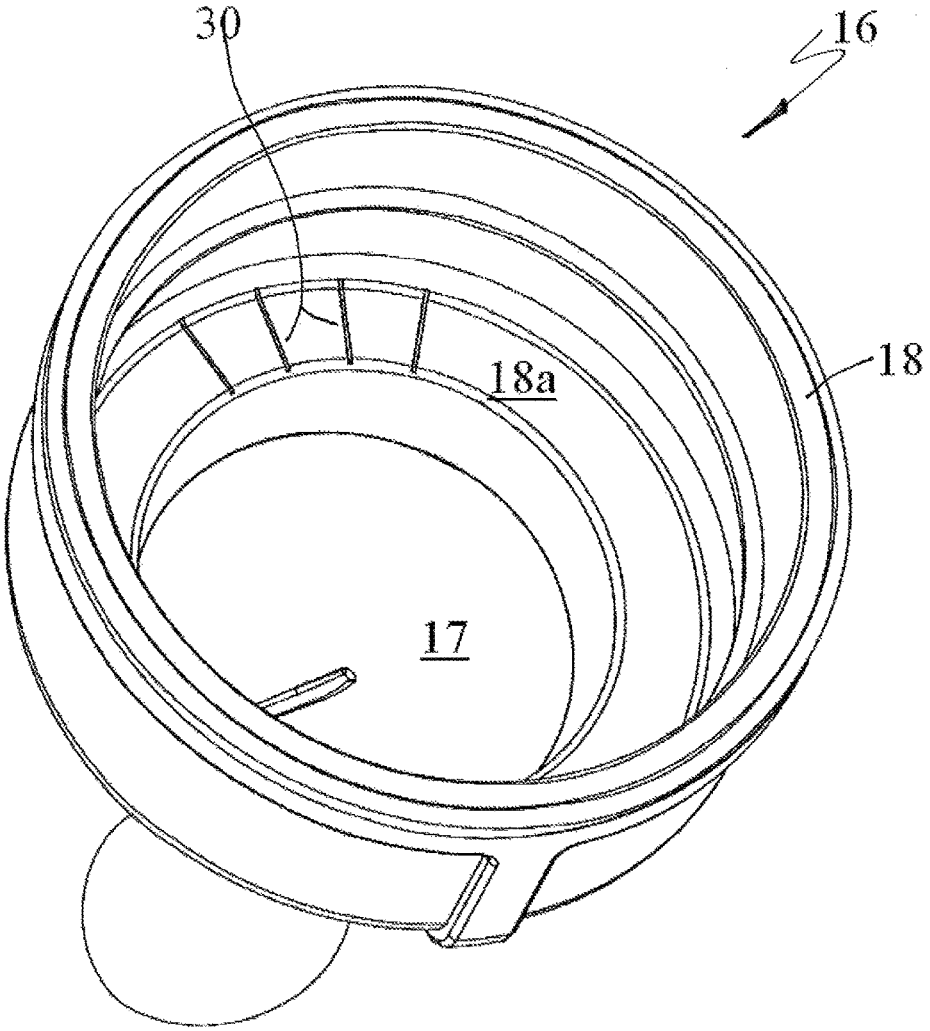
FIG. 7 shows a bottom perspective view of the outlet portion of FIG. 2.

As is shown in FIG. 7, in accordance with the present invention, venting of the receptacle 10 when assembled is primarily achieved through the provision of multiple grooves 30 formed in the undersurface of the collar member 18 of the outlet portion 16. In the embodiment as shown, each of these grooves 30 are formed in the horizontally extended portion 18*a* of the collar member 18 such that they form small channels that extend across the surface thereby forming a gap, even when the collar member 18 is securely tightened to the bottle portion 12 and the upper rim of the bottle portion 12 is in direct contact with the horizontally extending portion 18*a* of the collar member. In this regard, the grooves 30 have a length that is greater than the width of the upper rim of the bottle portion 12 to provide a path for air to pass from the region external of the bottle portion 12 to the internal region of the bottle portion. Alternatively, the grooves 30 may be formed in the upper rim of the open upper portion 15 of the bottle portion 12 as is depicted in FIGS. 15A and 15B.

Figure 8B:
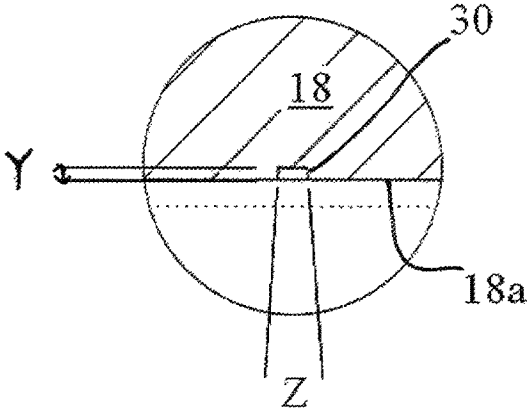
FIG. 8B shows and enlarged side view of the outlet portion of FIG. 8A depicting the grooves.
Figure 8A:
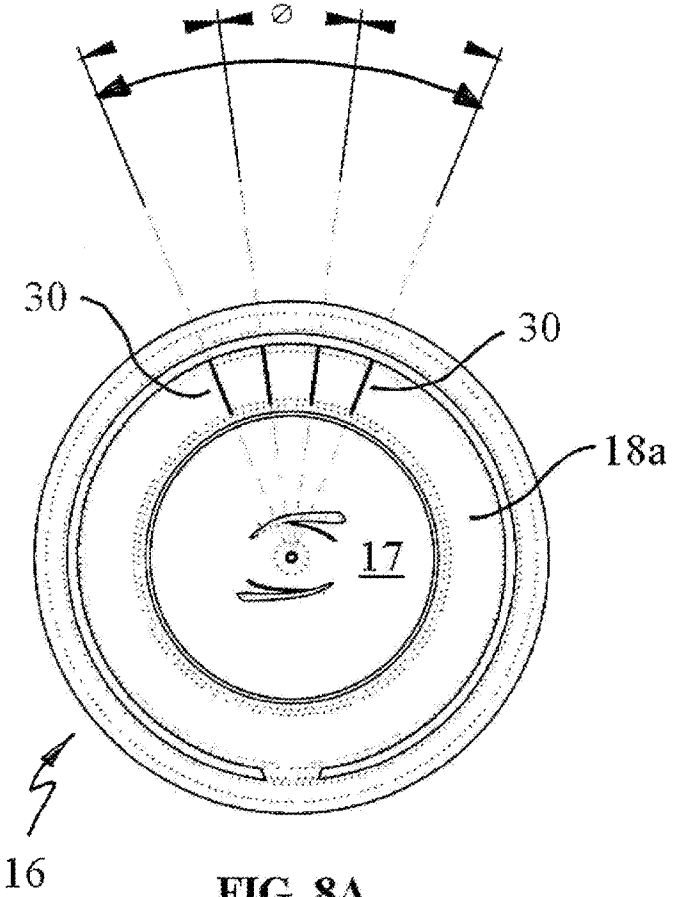
FIG. 8A shows a bottom view of the outlet portion of FIG. 2.

Referring to FIGS. 8A and 8B, the arrangement of the grooves 30 are depicted in more detail. As is shown in FIG. 8A, in a preferred form, the grooves 30 extend along a section of the horizontally extended portion 18*a* of the collar member 18 so as to subtend an arc of angle Ø. The angle Ø may be an angle of 45°, although other angles are also envisaged. In a preferred form, each of the grooves 30 is also regularly spaced apart in the manner as shown to form a venting section of the collar member 18, although irregular spacing is also envisaged.

As is shown in FIG. 8B, the grooves 30 are formed in the surface of the horizontally extended portion 18*a* of the collar member 18 so as to have a depth 'Y' and a width 'Z'. In a preferred form, the depth 'Y' may be between around 0.03 mm-0.20 mm, preferably around 0.08 mm and the width 'Z' may vary between 0.10 mm to 1.00 mm, preferably around 0.20 mm. Further, the width 'Z' may vary along the length of the groove, with the width being wider at one end compared to the other. It will be appreciated that the purpose of the grooves 30 is to permit the ingress of air into the bottle portion of the receptacle and to prevent the leakage of fluid from the bottle portion, and as such, the dimensions of the groove are sufficient to achieve that purpose. It is preferable that the grooves are provided in the section of the collar member that faces upwards when the receptacle is in use, to ensure that the air is able to more freely enter the bottle portion and to reduce the likelihood of any leakage occurring through effects of fluid head pressure.

The number of grooves 30 provided on the collar member 18 may vary, and in a preferred form, four grooves 30 are provided. It has been found that the grooves 30 function to form a vent when a suction force is applied to the teat member 17. In this regard, due to the configuration of the grooves, in the absence of a suction force being applied to the teat portion 17, a vacuum is maintained within the bottle as the grooves 30 have a configuration that ensures the surface tension of the fluid at the grooves 30 is maintained to reduce the likelihood of fluid, namely air or milk, passing through the grooves. As a suction force is applied to the teat portion 17 by the infant, the surface tension at one or more of the grooves 30 is broken thereby allowing air to enter into the bottle through the grooves to replace the fluid exiting the outlet 19 of the teat portion 17. Once the suction force is removed the surface tension at the grooves is maintained to ensure that a degree of vacuum force is still present within the receptacle. In this regard, there is a redundancy in the number of grooves or vents 30 provided and if a high degree of suction force is applied to the teat portion more than one groove 30 may "open" to enable air to enter the bottle. By altering the dimensions of the grooves 30, i.e. by making the grooves 30 deeper or wider, the amount of vacuum present in the bottle can be altered.

It will be appreciated that the purpose of the grooves 30 is to provide a degree of venting to the receptacle to ensure that receptacles that employ the arrangement of the present invention all exhibit a consistent flow characteristic. This is different to the flow rate of the receptacle, which is determined by the size of the outlet 19 formed in the teat member 17. By altering the orifice size of the outlet 19 differing flow rates of fluid can be delivered to the infant. Thus, for a given orifice size, the grooves 30 of the venting system of the present invention provide a consistent flow characteristic between receptacles and ensure that there will always be an inherent vacuum within the receptacle which will be broken upon application of a sucking force to the teat member 17, to ensure that fluid will flow to the infant as a result of the sucking force.

Figure 9A:
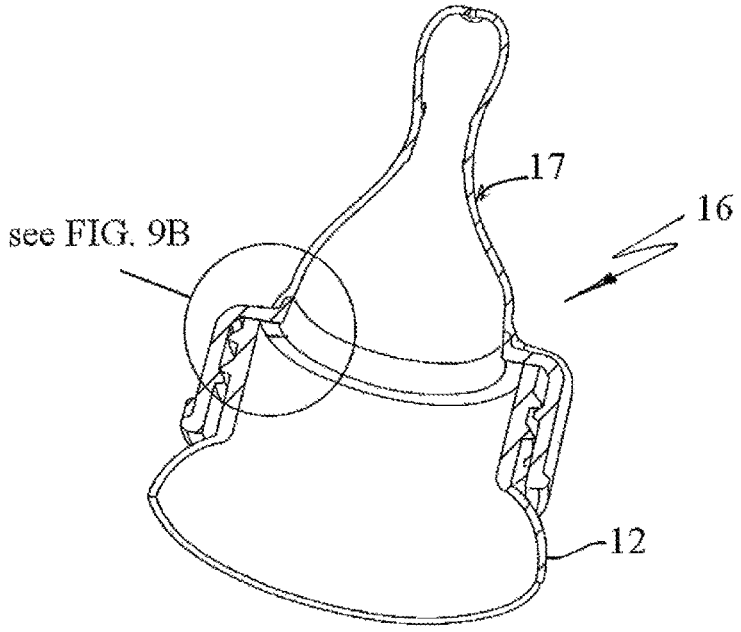
FIG. 9A is a cross-sectional perspective view of the receptacle of FIG. 1 with the outlet portion secured to the bottle portion.
Figure 9B:
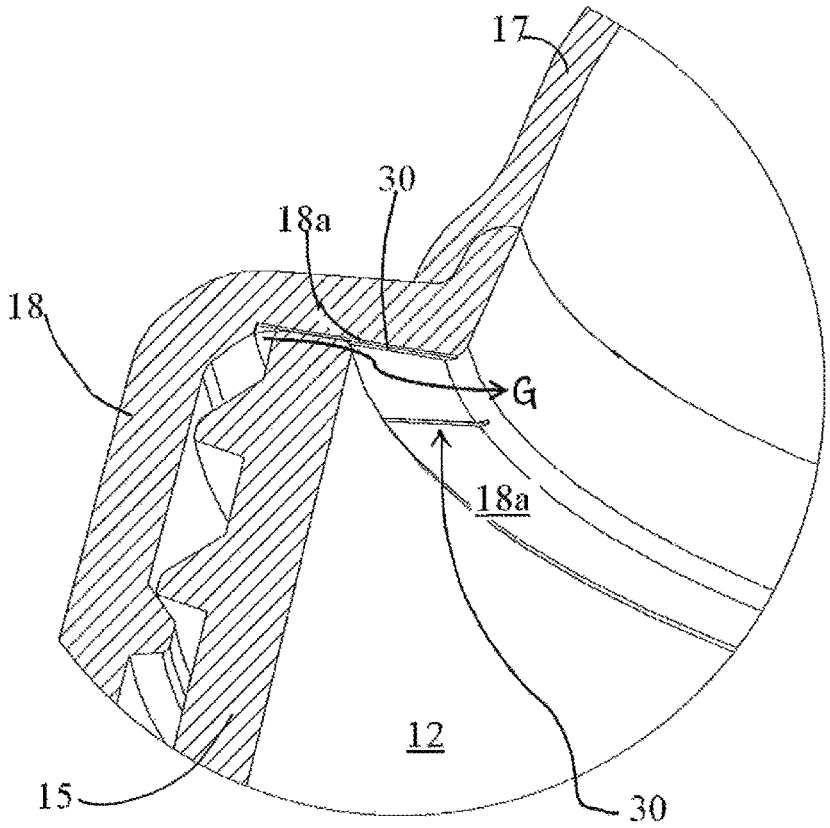
FIG. 9B is an enlarged view of FIG. 9A.

Referring to FIGS. 9A and 9B, the manner in which the venting of the receptacle is achieved can be readily understood. The cross-section depiction of FIG. 9A shows the manner in which the outlet portion 16 is engaged with the open upper portion 15 of the bottle 12, such that the upper rim of the open upper portion 15 of the bottle 12 is in contact with the surface of the horizontal portion 18*a* of collar member 18.

In the enlarged view of this arrangement as shown in FIG. 9B, when the collar member 18 is screwed tightly in position onto the upper rim of the open upper portion 15 of the bottle 12, air is still able to enter the interior space within the teat member 17 by following the path depicted by the arrow 'G' as determined by groove 30. As discussed above, in a normal state where no suction is applied to the teat member 17, the fluid within the bottle is enclosed within a vacuum, and as such the surface tension of the fluid is sufficient to prevent air passing through the grooves 30. When a suction force is applied to the teat member 17, the fluid within the teat member 17 is typically removed under suction, thereby breaking the surface tension of the grooves 30 and drawing air into the teat member 17 through the vents 30. Such an arrangement ensures that the fluid is able to flow from the outlet in the teat member 17 in a desired manner, without creating a vacuum effect in the receptacle 10.

It will also be appreciated that rather than grooves 30 formed in the underside of the horizontal surface 18*a* of the collar portion 18, the venting can be achieved by variations in the surface finish 31 of the underside of the horizontal surface 18*a*. This could be formed by etching, EDM or any other surface roughening techniques, and is depicted in FIG. 14.

It will be appreciated that in each of the embodiments described above and as depicted in FIGS. 7-9*b*, the surfaces between the bottle portion 12 and the collar portion 18*a* which contact are relatively smooth and free of debris which enables the grooves or vents 30 to function substantially unimpeded. However, with the provision of pre-prepared or pre-mixed fluid as an option, it is possible that the bottle portion 12 may be provided separately to the outlet portion 16 and assembled together upon purchase. In this regard, it is possible that a removable tamper proof seal may be applied to the opening of the bottle portion 12 such that it must be removed prior to assembling the outlet portion 16 to the bottle portion 12. In such instances, the tamper proof seal may be applied to the upper rim of the bottle portion with an adhesive, such that after removal of the tamper proof seal the surface of the upper rim of the bottle portion may be rough which could block the vents or grooves 30 when the bottle portion 12 is in engagement with the outlet portion 16. To address this issue, variations of the manner in which the venting of the receptacle 10 is achieved are depicted in FIGS. 10-13.

Figure 10A:
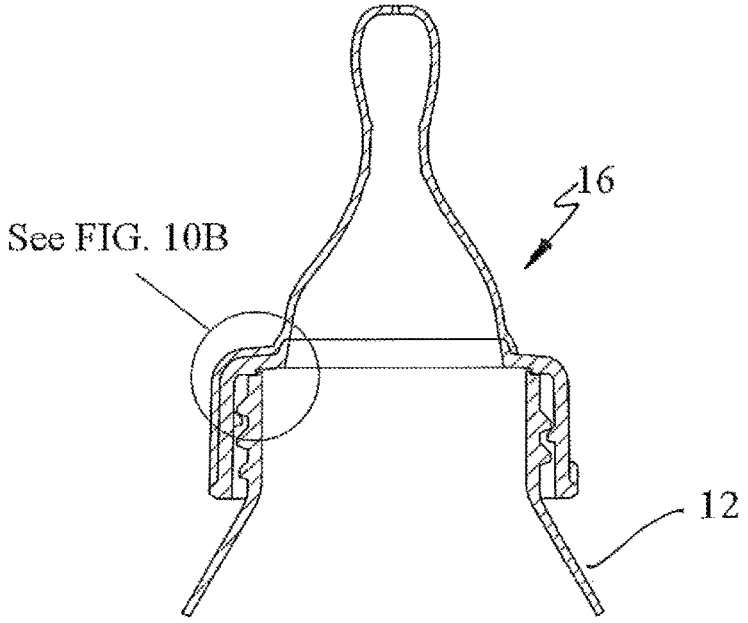
FIG. 10A is a cross-sectional perspective view of an alternative embodiment of a receptacle according to the present invention with the outlet portion secured to the bottle portion.
Figure 10B:
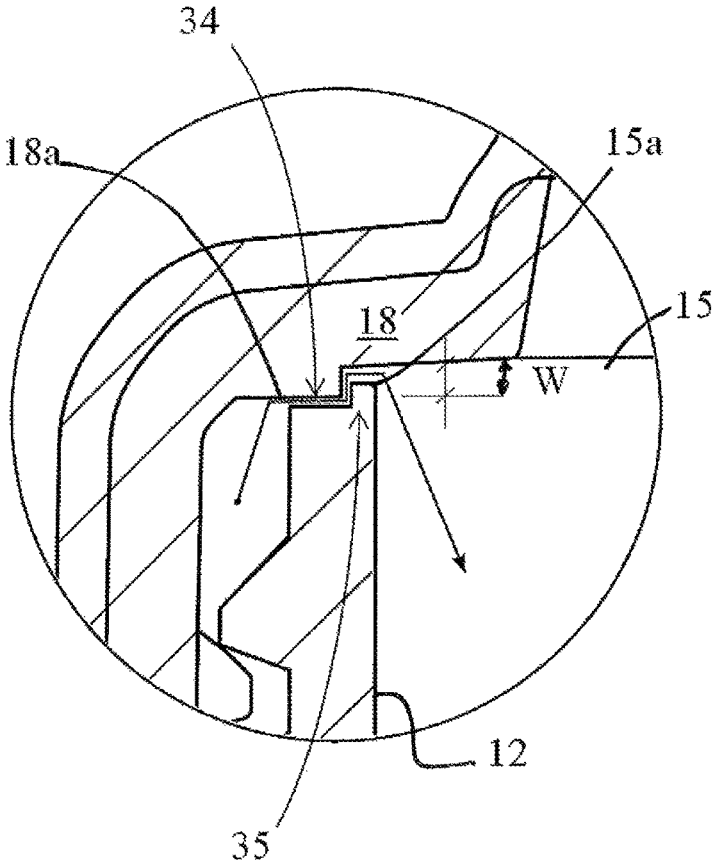
FIG. 10B is an enlarged view of FIG. 10A.

With regard to the embodiment depicted in FIGS. 10A and 10B, in order to assist in the achievement of venting, a step 35 is formed in the rim of the open upper portion 15 of the bottle which cooperates with a corresponding step 34 formed in the underside of the horizontal surface 18*a* of the collar portion 18. In this arrangement, the one or more grooves 30 are formed in the surface 18*a* as depicted above, such that even if a tamper proof seal is applied to the surface 15*a* of the upper rim 15 of the bottle portion 12, the receptacle will still be vented when the outlet portion 16 is fitted to the bottle 12. In this regard, a clearance 'W' is created between the surface 15*a* and the collar portion 18 to cater for any potential adhesive residue or the like that may be left behind when the tamper proof seal is removed and which may potentially block the grooves 30. As the grooves 30 are formed in the surface 18*a* of the collar 18 and surface 18*a* is not in direct contact with the surface 15*a* which the tamper proof seal was attached to, venting of the receptacle is assured in this instance even if debris remains on the surface 15*a* after the tamper proof seal has been removed.

Figure 11A:
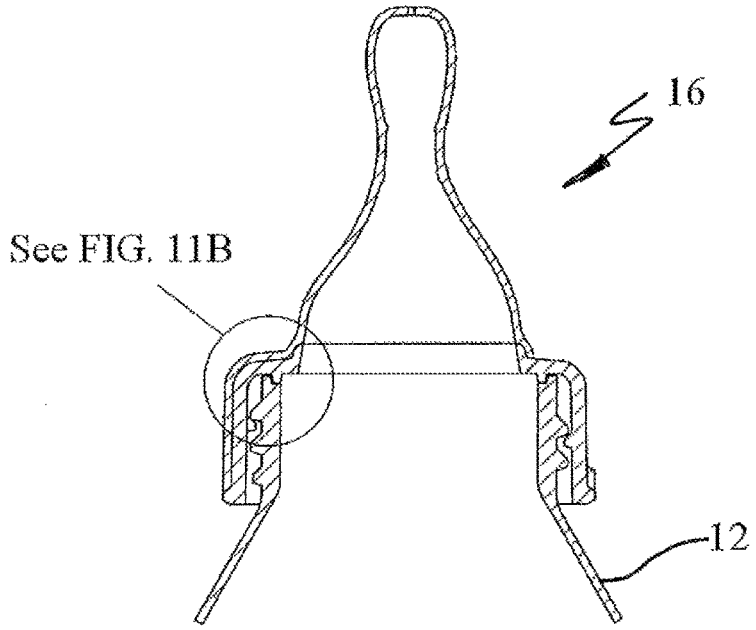
FIG. 11A is a cross-sectional perspective view of an alternative embodiment of a receptacle according to the present invention with the outlet portion secured to the bottle portion.
Figure 11B:
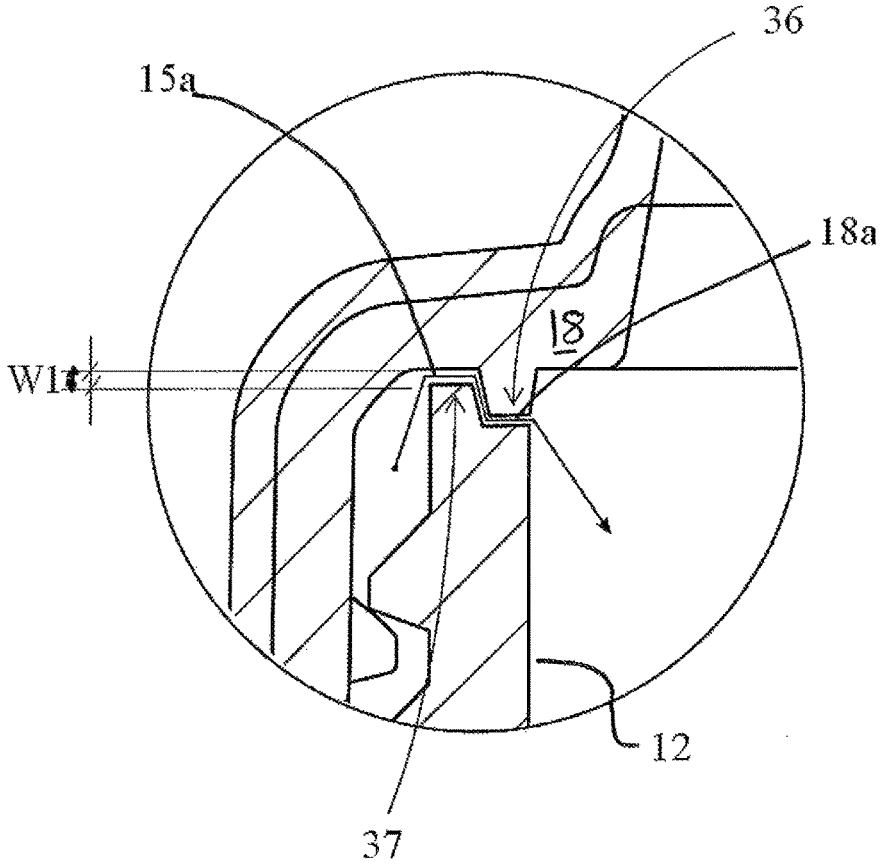
FIG. 11B is an enlarged view of FIG. 11A.

With regard to the embodiment depicted in FIGS. 11A and 11B, a variation of the arrangement shown in FIGS. 10A and 10B is depicted. In this embodiment, in order to achieve venting, a step 37 is formed in the rim of the open upper portion 15 of the bottle which cooperates with a corresponding step 36 formed in the underside of the horizontal surface 18*a* of the collar portion 18. In such an arrangement, a tamper proof seal may be attached to the upper surface 15*a* of the open upper rim portion 15 of the bottle 12 and can be removed prior to assembling the outlet portion 16 to the bottle portion 12 as shown in FIG. 11A. As discussed above, after removal of a tamper proof seal from the surface 15*a*, there may be residual debris remaining on the surface 15*a* which could potentially block any groove or vent provided on a surface of the collar portion 18 that comes into contact with the surface 15*a*. To address this, the grooves are provided in the surface 18*a* of the collar portion 18 which does not come into contact with the surface 15*a* of the upper rim portion 15 of the bottle 12 and a clearance 'W1' is created above the surface 15*a* to cater for any residual debris that may remain thereon after removal of the tamper proof seal.

Figure 12A:
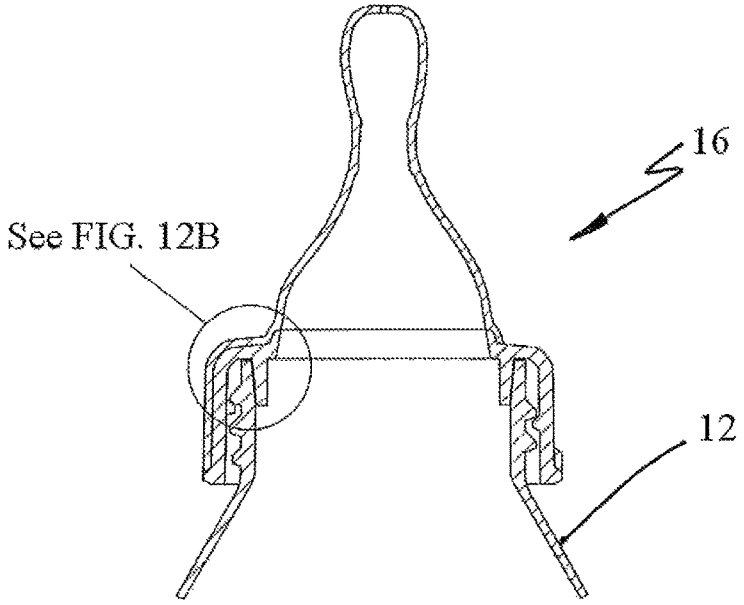
FIG. 12A is a cross-sectional perspective view of an alternative embodiment of a receptacle according to the present invention with the outlet portion secured to the bottle portion.
Figure 12B:
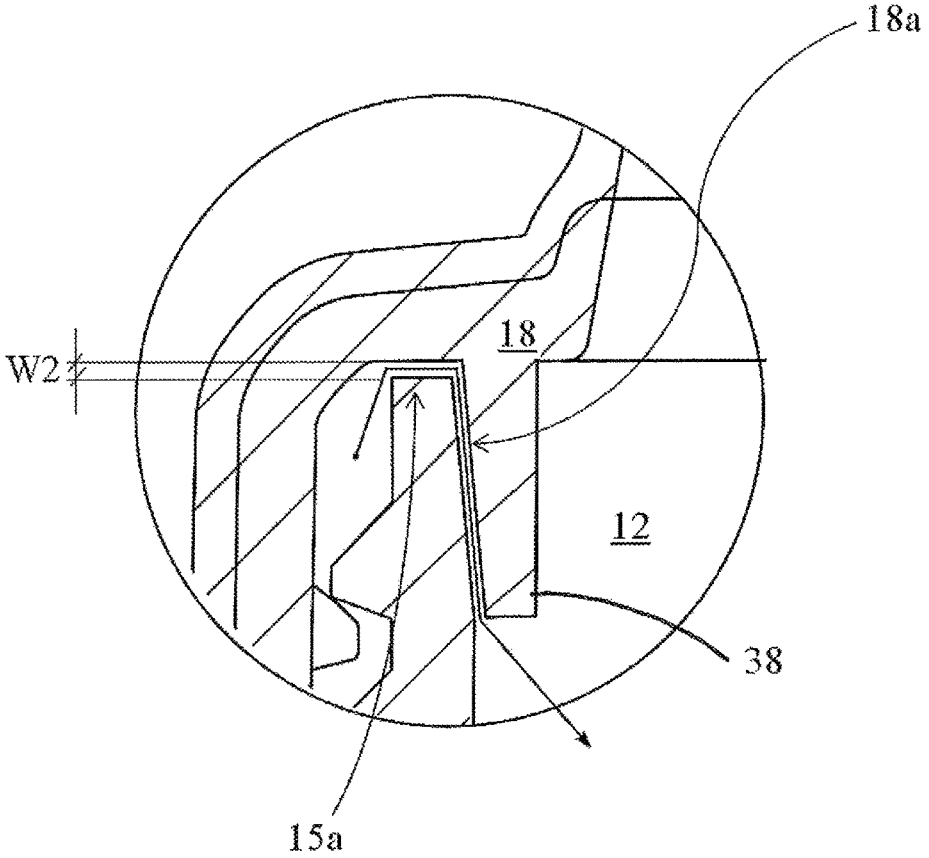
FIG. 12B is an enlarged view of FIG. 12A.

With regard to the embodiment depicted in FIGS. 12A and 12B, yet another variation of the arrangement described above is depicted. In this embodiment, a tamper proof seal may be applied to the surface 15*a* of the upper rim portion 15 such that upon removal of the tamper proof seal the surface 15*a* may contain residual debris that may block any grooves or vents that may come into contact with it. In order to address this, a lug 38 is provided on the collar 18 to extend in a downward manner so as to penetrate into the open upper portion 15 of the bottle, as shown in FIG. 12B. The inner surface of the open upper portion 15 of the bottle is angled to substantially conform to the outer surface of the lug 38 and the grooves or vents 30 are formed on the outer surface 18*a* of the lug 38. In this arrangement the grooves or vents 30 do not come into contact with the surface 15*a* and a clearance W2 is created above the surface 15*a* as shown.

Figure 13A:
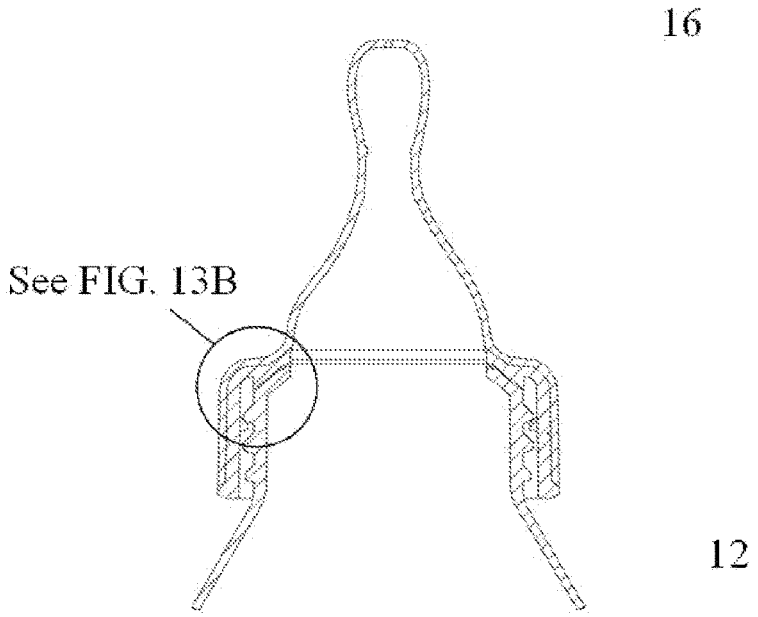
FIG. 13A is a cross-sectional perspective view of an alternative embodiment of a receptacle according to the present invention with the outlet portion secured to the bottle portion.
Figure 13B:
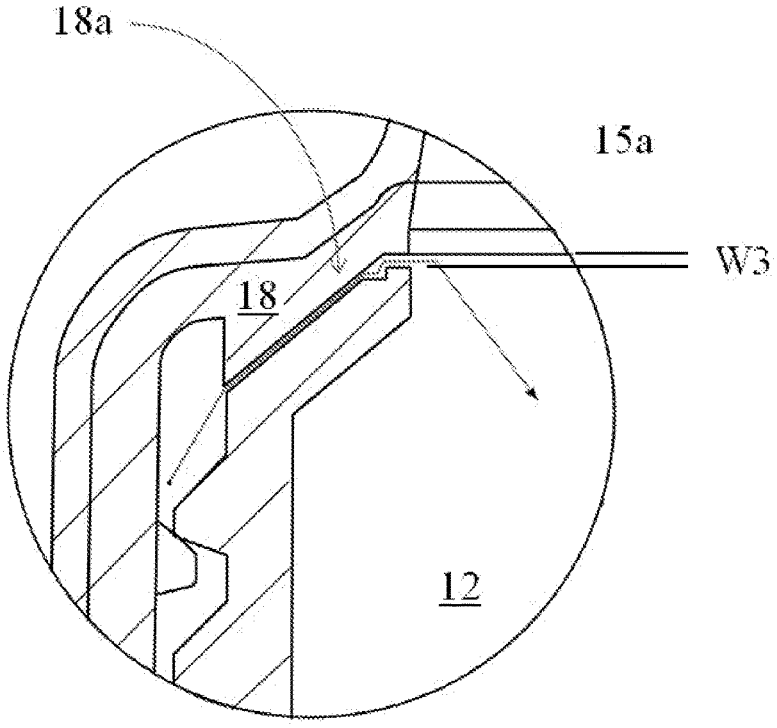
FIG. 13B is an enlarged view of FIG. 13A.

With regard to the embodiment depicted in FIGS. 13A and 13B, yet another variation of the arrangements described above is depicted. In this embodiment, in order to achieve venting, the mating surfaces of the collar portion 18 and the open upper portion 15 of the bottle are angled to define a venting path therebetween. The inner horizontal surface 15*a* of the open upper portion 15 of the bottle portion 12 may have a tamper proof seal applied thereto which, when removed, may have residual debris formed thereon which may potentially block or adversely interfere with any grooves or vents formed on a surface of the collar portion 18 that engages therewith. To address this, grooves are provided in the surface 18*a* of the collar portion 18 that is remote from the surface 15*a* to ensure venting of the bottle portion is still possible, even in the event of the surface 15*a* containing debris. Clearance W3 is also formed over the surface 15*a* as shown.

It will be appreciated that in each of the embodiments discussed above for venting the receptacle, the grooves are provided in the underside of the collar portion to provide a passage for air to enter the internal region of the receptacle to replace the space filled by the departing fluid. This is achieved without creating fluid leakage by controlling the depth and size of the grooves. This receptacles incorporating the venting arrangement of the present invention provide a consistent flow characteristic between receptacles that ensure that a natural vacuum is present in the receptacle when not in use, and when in use and a suction force is applied to the receptacle to withdraw fluid therefrom, venting is possible to ensure that the vacuum is broken and fluid flow is possible. However, the flow rate of the receptacle is generally determined by the size of the orifice of the outlet. Receptacles having the above described venting arrangement do not leak when turned upside down due to the size and shape of the grooves ensuring that there is sufficient surface tension present between the fluid and air interface to prevent inadvertent leakage of fluid therefrom. This is achieved even if the receptacle is upside down whereby the effect of gravity is not enough to overcome the tension forces present therein. As such, in order for the receptacle to vent and release fluid, a pressure needs to be applied to the receptacle.

It will be appreciated that whilst the above invention has been discussed above in relation to infant feeding bottles, the same principles can be applied when used with sports drinking bottles or other receptacles which employ an outlet portion that releases the fluid, under pressure, in a controlled manner.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the infant feeding bottle uppermost.

It will be appreciated by those skilled in the art that many modifications and variations may be made to the methods of the invention described herein without departing from the spirit and scope of the invention.

The claims defining the invention are as follows:

1. A drinking receptacle comprising:

a container for containing a fluid for drinking; and an outlet member having:

an outlet through which the fluid is delivered under a pressure supplied by a user of the receptacle; and a collar portion that attaches to an opening of the container such that an undersurface of the collar portion abuts with an upper surface of the opening of the container to form a substantially sealed engagement between the outlet member and the container;

wherein, both the undersurface of the collar portion and the upper surface of the opening of the container are formed from a hard, substantially non-deformable material such that the undersurface of the collar portion and the upper surface of the opening of the container are configured to abut under pressure without deforming, and either the undersurface of the collar portion or the upper surface of the opening of the container that abut each other under pressure has at least one vent formed therein to extend across the abutting surfaces, the at least one vent being configured such that when said pressure is applied to the outlet member the at least one vent member permits the controlled ingress of air into the container to facilitate flow of fluid from the outlet, and when said pressure is removed the at least one vent member substantially prevents the ingress of air into the container to facilitate a controlled vacuum pressure within the container.

2. A drinking receptacle according to claim 1, wherein the pressure applied to facilitate delivery of fluid from the container via the outlet is a negative or vacuum pressure.

3. A drinking receptacle according to claim 2, wherein the at least one vent comprises one or more channels formed in the undersurface of the collar portion or the upper surface of the opening of the container such that the channel extends across the abutting surfaces of the collar portion and the opening of the container.

4. A drinking receptacle according to claim 2, wherein the at least one vent comprises a variation in a surface finish formed in the undersurface of the collar portion or the upper surface of the opening of the container such that the variation in the surface finish extends across the abutting surfaces of the collar portion and the opening of the container.

5. A drinking receptacle according to claim 2, wherein the hard, substantially non-deformable material is a hard plastic material, wherein the hard plastic material is comprised of polypropylene.

6. A drinking receptacle according to claim 1, wherein the pressure applied to facilitate delivery of fluid from the container via the outlet is a positive pressure.

7. A drinking receptacle according to claim 6, wherein the at least one vent comprises one or more channels formed in the undersurface of the collar portion or the upper surface of the opening of the container such that the channel extends across the abutting surfaces of the collar portion and the opening of the container.

8. A drinking receptacle according to claim 6, wherein the at least one vent comprises a variation in a surface finish formed in the undersurface of the collar portion or the upper surface of the opening of the container such that the variation in the surface finish extends across the abutting surfaces of the collar portion and the opening of the container.

9. A drinking receptacle accoridng to claim 6, wherein the hard, substantially non-deformable material is a hard plastic material, wherein the hard plastic material is comprised of polypropylene.

10. A drinking receptacle according to claim 1, wherein the at least one vent comprises one or more channels formed in the undersurface of the collar portion or the upper surface of the opening of the container such that the channel extends across the abutting surfaces of the collar portion and the opening of the container.

11. A drinking receptacle according to claim 1, wherein the at least one vent comprises a variation in a surface finish formed in the undersurface of the collar portion or the upper surface of the opening of the container such that the variation in the surface finish extends across the abutting surfaces of the collar portion and the opening of the container.

12. A drinking receptacle according to claim 1, wherein the hard, substantially non-deformable material is a hard plastic material, wherein the hard plastic material is comprised of polypropylene.

* * * * *